United States Patent [19]

Miller

[11] 4,141,525

[45] Feb. 27, 1979

[54] UNIVERSAL DRAWER SLIDE MOUNTING BRACKET

[75] Inventor: Calvin K. Miller, Grand Rapids, Mich.

[73] Assignee: Knape & Vogt Manufacturing Co., Grand Rapids, Mich.

[21] Appl. No.: 850,407

[22] Filed: Nov. 10, 1977

[51] Int. Cl.[2] ..... A47B 88/00

[52] U.S. Cl. ..... 248/251; 312/334

[58] Field of Search ..... 248/251, 262, DIG. 9, 248/300; 312/334, 335, 343, 342, 348

[56] References Cited

U.S. PATENT DOCUMENTS

| | | | |
|---|---|---|---|
| 1,352,652 | 9/1920 | Boye | 248/262 |
| 2,202,209 | 5/1940 | Kennedy | 312/342 |
| 2,638,643 | 5/1953 | Olson | 248/300 X |
| 3,139,313 | 6/1964 | Rule | 312/248 X |
| 3,149,811 | 9/1964 | Fremstad et al. | 248/251 |
| 3,375,051 | 3/1968 | Anderson | 312/343 |
| 3,675,883 | 7/1972 | Holmes | 248/251 |
| 3,784,274 | 1/1974 | Holmes | 312/248 X |
| 3,980,365 | 9/1976 | MacDonald | 312/348 X |
| 4,061,375 | 12/1977 | Mertes | 312/348 X |

*Primary Examiner*—J. Franklin Foss

*Attorney, Agent, or Firm*—Price, Heneveld, Huizenga & Cooper

[57] ABSTRACT

An omni orientation mounting bracket for multiple positioning use with a drawer rail assembly, being a unitary member composed of a channel sleeve integral with an orificed mount plate along a linear juncture, the mount plate having a plurality of bend loci formed by aligned orifices, one of which bend loci lies along said linear juncture and the others being normal thereto, with portions of said mount plate being formable along said bend loci in a multiple of directions.

1 Claim, 7 Drawing Figures

UNIVERSAL DRAWER SLIDE MOUNTING BRACKET

BACKGROUND OF THE INVENTION

This invention relates to mounting brackets for drawer rail assemblies. Mounting brackets for attaching drawer rails to cabinets or other structures presently exist in a variety of sizes, styles, and configurations. Because cabinets are variously structured, an assortment of mounting brackets is marketed, of left and right-hand type, some for back mounting, some for bottom mounting, some for top mounting, and some for side mounting.

SUMMARY OF THE INVENTION

The mounting bracket of this invention is itself capable of back mounting, bottom mounting, top mounting, or side mounted, right or left-hand, yet produced on mass production basis on progressive dies. The rail supporting mount plate component of the bracket, integral with the drawer rail receiving channel sleeve, has a plurality of elongated linear bend loci, one being on the juncture between the mount plate and the channel sleeve, and the others transverse thereto. The back panel of the channel sleeve has a projecting tab for applying a biasing force to a drawer rail in the sleeve.

A primary object of the invention therefore, is to provide an omni orientation one piece mounting bracket for drawer rail assemblies, formable into desired mounting orientations.

DESCRIPTION OF THE PREFERRED EMBODIMENT

Figure 3:
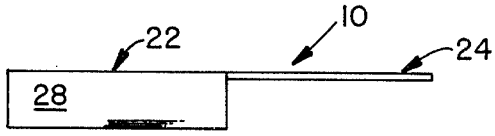
FIG. 3 is a top plan view of the bracket in FIG. 1.
Figure 2:
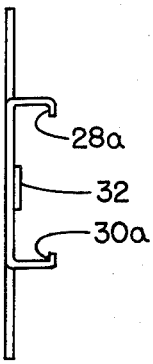
FIG. 2 is an end elevational view of the bracket in FIG. 1.

The novel bracket 10 is primarily intended as a rear mounting bracket for a mounting rail or channel 12 of a conventional drawer rail assembly. Since such conventional drawer rail assemblies assume a variety of forms, the details of a particular assembly are not set forth but rather only the mounting channel portion thereof for illustrative purposes. Such a channel is U-shaped in cross section, with a vertical back panel 14 and a pair of upper and lower flanges 16 and 16', there being appropriate orifices 18 along the length thereof for attachment to the cabinet (not shown) and optional front structure 20 cooperative with the drawer itself (not shown). The novel bracket 10 is intended primarily to support the rear end of the mounting rail 12 of the drawer rail assembly.

Figure 4:
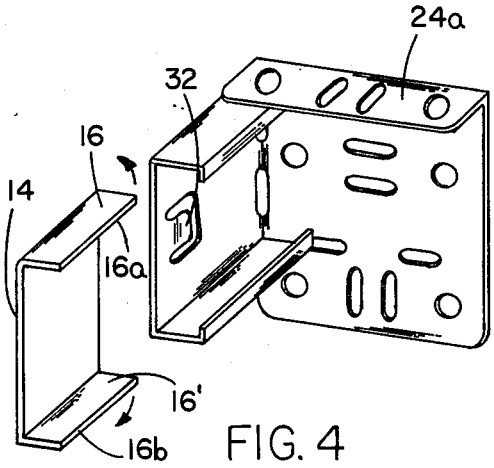
FIG. 4 is an exploded perspective view of the bracket in FIGS. 1–3 with a portion of a drawer rail channel, the bracket being configurated to an orientation for top mounting.
Figure 7:
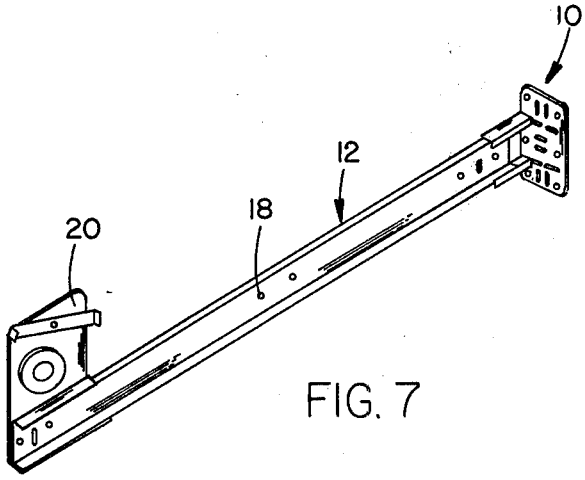
FIG. 7 is a perspective view of the novel bracket shown in a typical combination with the mounting channel rail of a drawer rail assembly.

This bracket 10 is a unitary member formed of two components integrally connected with each other along a linear juncture. More specifically, the bracket includes a drawer rail support in the form of a channel sleeve 22 and an orificed mount plate 24. Channel sleeve 22 has a back panel 26 and a pair of spaced upper and lower side panels 28 and 30 parallel to each other and transverse to back panel 26, normally perpendicular thereto. The side panels 28 and 30 have flanges 28' and 30' to retain the drawer rail 12 in telescopic condition therein (FIG. 7). Back panel 26 includes an integral tab 32 defined on three edges by a punched out U-shaped orifice or opening 34. The tab projects slightly into the space defined by the sleeve to apply a bias to back panel 14 of the drawer channel 12. The tab is preferably somewhat curved. The resulting lateral pressure on the drawer rail channel serves to frictionally take up any slack between the members for eliminating rattle and also to slightly deflect the free edges of side panels 16 and 16' outwardly away from each other as indicated by the arrows in FIG. 4, to effect engagement of slide edges **16*a* and 16*b* with the corners 28*a* and 30*a* of the bracket sleeve at the junctions of panel 28 with its flange 28' and panel 30 with its flange 30'**, respectively.

Figure 5:
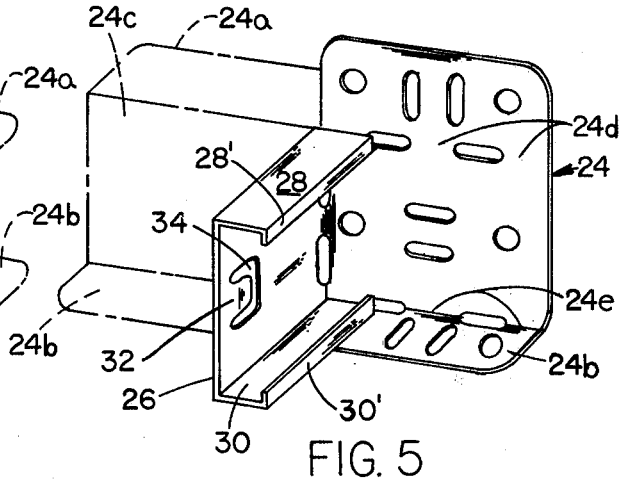
FIG. 5 is a perspective view of the bracket in FIG. 1 shown in another orientation for bottom mounting, and also showing alternate orientations in phantom lines.

Mount plate 24 in its initial form is a planar member having a series of orifices therein, some of which are elongated as at **36*a* and some of which may not be elongated as at 36*b*. These orifices are placed in a plurality of positions over the surface of the mount plate to allow highly selective use thereof for attachment by suitable fasteners such as screws or tacks to the cabinet structure within which the bracket is placed. Importantly, some of the orifices are placed in alignment with each other from one edge of the unit to the opposite edge to allow multiple direction orientation of portions of the mount plate. These plurality of orifices effect elongated linear bend loci. One of these elongated bend loci is at the integral juncture between the mount plate and the sleeve. Specifically, elongated spaced orifices 36*c* are linearly aligned with each other and along the linear juncture of the mount plate and sleeve, leaving a series of linearly aligned, spaced isthmuses 38 along the juncture. These collectively form a bend line between mount plate 24 and sleeve 22 to enable the plate to be readily changed in its orientation relative to the sleeve, typically normal thereto, to a position shown in solid lines in FIG. 5 for example, or alternately in the opposite direction as shown in phantom lines in FIG. 5. The unit can be a left-hand or right-hand mounting bracket for either side of the drawer structure. The function of the elongated orifices 36*c* at this bend line can optionally be assisted by a crease formed into the material across the isthmuses 38**.

Figure 6:
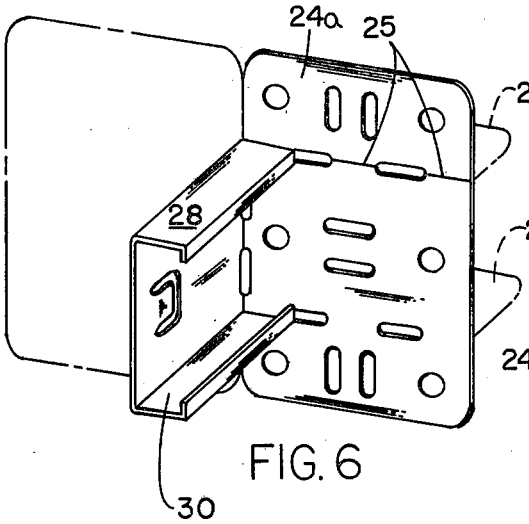
FIG. 6 is a perspective view of the bracket in FIG. 1 oriented for back mounting, and showing alternate configuration in phantom lines.

In addition to the bend line formed at this juncture, there are preferably two additional bend lines normal to the juncture bend line, and parallel to each other, extending from one peripheral edge of the mount plate to the opposite edge. More specifically, the upper and lower portions of the mount plate extend normal to the elongated dimension of sleeve 22, beyond side panels 28 and 30 of the sleeve, to form mounting flange portions **24*a* and 24*b*. These mounting flange portions are integral with the remaining portions of the bracket but are readily oriented into a desired position transverse to central portion 24*c* of the plate, by being joined to the central portion by isthmuses spaced by elongated orifices to form bend loci. Particularly, flange portion 24*a*** is joined to the central portion of the plate by isthmuses 24*d* spaced by aligned orifices 40. Likewise, flange portion **24*b* is integrally interconnected with central portion 24*c* by isthmuses 24*e* spaced by elongated aligned orifices 42. The sets of aligned orifices 40 and 42 thus respectively form two elongated linear bend lines to allow the flange portions 24*a* and 24*b* to be reoriented transverse to the direction of the central plate member, i.e. rearwardly as shown by the phantom lines in FIG. 6, forwardly as shown by flange 24*b* in FIG. 5 and flange 24*a* in FIG. 4, or alternately one rearward and one forward as depicted in phantom lines in FIG. 5. As illustratively shown by phantom lines at 25 in FIG. 6 relative to upper flange 24*a***, one or more of these bend lines can include creases or indentations to further facilitate reorientation of the plate portions if desired.

Figure 1:
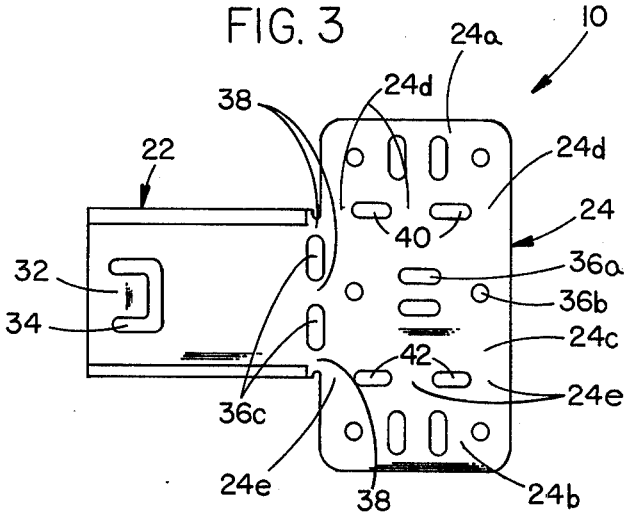
FIG. 1 is a side elevational view of the novel bracket.

As will be readily apparent from the drawings and the above description, selected portions of the novel bracket can be readily oriented for side mounting (FIG. 1), back mounting (solid lines in FIG. 6), bottom mounting (solid lines in FIG. 5), top mounting (solid lines in FIG. 4), and left or right-hand arrangement to accommodate left or right-hand drawer rails, being omni positional, yet simple in structure and capable of being formed of one piece by high speed production techniques, preferably with progressive dies.

Certain additional advantages and arrangements of the bracket will be readily apparent to those in the art upon studying the foregoing disclosure.

The embodiments of the invention in which an exclusive property or privilege is claimed are defined as follows.

1. An omni orientation mounting bracket for selective multiple position use to support a drawer rail assembly, comprising:

a one piece bracket having a channel sleeve to interfit with a drawer rail, and a mount plate for cabinet attachment; said channel sleeve having a back panel and a pair of side panels transverse to said back panel; said mount plate being integrally joined with said channel sleeve at said back panel along a linear juncture, and having a plurality of peripheral edges; said mount plate having plate portions and at least two bend lines, one of which bend lines is along said linear juncture and the other of said bend lines between said plate portions to allow said mount plate portions to be positioned in selected orientation relative to said channel sleeve; said bend lines having aligned spaced orifices and isthmuses therealong.

* * * * *